US008331841B2

(12) United States Patent
Maruko et al.

(10) Patent No.: US 8,331,841 B2
(45) Date of Patent: Dec. 11, 2012

(54) FIXING DEVICE AND IMAGE FORMING APPARATUS

(75) Inventors: Masami Maruko, Hachioji (JP); Tetsuko Kurosu, Hino (JP); Satoshi Hamaya, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 26 days.

(21) Appl. No.: 12/810,825

(22) PCT Filed: Aug. 3, 2009

(86) PCT No.: PCT/JP2009/063733

§ 371 (c)(1),
(2), (4) Date: Jun. 25, 2010

(87) PCT Pub. No.: WO2010/024092

PCT Pub. Date: Mar. 4, 2010

(65) Prior Publication Data

US 2011/0135354 A1 Jun. 9, 2011

(30) Foreign Application Priority Data

Aug. 29, 2008 (JP) ..... 2008-221038

(51) Int. Cl.
*G03G 15/20* (2006.01)

(52) U.S. Cl. ..... 399/329; 219/216

(58) Field of Classification Search ..... 399/328–329; 219/216

See application file for complete search history.

(56) References Cited

U.S. PATENT DOCUMENTS 5,528,338 A * 6/1996 Kobayashi et al. ..... 355/27
7,392,005 B2 * 6/2008 Kaji et al. ..... 399/328
7,447,474 B2 * 11/2008 Fujino ..... 399/329
2004/0223795 A1 * 11/2004 Ono et al. ..... 399/329
2011/0142502 A1 * 6/2011 Torimaru ..... 399/312

FOREIGN PATENT DOCUMENTS

| | | |
|---|---|---|
| JP | 7-10344 | 1/1995 |
| JP | 9-90787 | 4/1997 |
| JP | 2001-201979 | 7/2001 |
| JP | 2002-333789 | 11/2002 |
| JP | 2007-79049 | 3/2007 |

OTHER PUBLICATIONS

English-language International Search Report from the Japanese Patent Office mailed Aug. 25, 2009, for International Application No. PCT/JP2009/063733.

Japanese Office Action corresponding to application No. 2010-510009, mailed Mar. 27, 2012.

* cited by examiner

*Primary Examiner* — David Gray
*Assistant Examiner* — G. M. Hyder
(74) *Attorney, Agent, or Firm* — Finnegan, Henderson, Farabow, Garrett & Dunner, L.L.P.

(57) ABSTRACT

Provided is an image forming apparatus having a fixing device for fixing an image at a nip portion formed of two rotary members which rotate while facing each other, wherein occurrence of uneven print gloss is prevented. The image forming apparatus having a fixing device for fixing an image at a nip portion formed of two rotary members which rotate while facing each other, wherein one of the two rotary members is a belt which rotates while being stretched around of a plurality of rollers, a roller arranged at the exit of the nip portion out of the plurality of rollers has a crown shape, and a slack absorbing member for absorbing a slack of both ends of the belt caused by the crown-shaped roller is in contact with the belt.

4 Claims, 4 Drawing Sheets

FIXING DEVICE AND IMAGE FORMING APPARATUS

CROSS REFERENCE TO RELATED APPLICATIONS

This application is a national phase application based on International Application No. PCT/JP2009/063733, filed Aug. 3, 2009, which claims the priority of Japanese Patent Application No. 2008-221038, filed Aug. 29, 2008, the content of both of which is incorporated herein by reference.

FIELD OF THE INVENTION

The present invention relates to a fixing device for heating a sheet carrying a toner image under pressure by conveying it, thereby fixing the toner image on the sheet and an image forming apparatus including the fixing device.

PRIOR ART

In an image forming apparatus such as an electrophotographic copying machine or a printer, in most cases, a sheet carrying a toner image is heated under pressure by a fixing device and the toner image is fixed onto the sheet.

At one time, the fixing device generally fixes an image by conveying a sheet carrying a toner image by a nip portion formed by rollers which are rotary members arranged opposite to each other, while in recent years, both or one of the rotary members uses generally a belt.

The fixing device using a belt for the rotary member can form a wide nip width, so that when giving a fixed quantity of heat to a sheet carrying a toner image, the set temperature can be made lower than that when the opposite rollers are used.

Such a characteristic offers the advantages of shortening the rise time of the fixing device and widening the mold release temperature range.

However, a separation roller for pressurizing the belt against the opposite rotary member at the exit of the nip portion is rotated under support at both ends of the shaft, so that it is bent in the axial direction, and the pressure of the belt against the opposite rotary member is not uniform, thus the pressure at the central part of the belt may be lower than that at both ends of the belt. A problem arises that the image may be disordered due to ununiformity of the pressure in the axial direction.

To prevent such a fault, an art of forming the separation roller in a crown shape that the outside diameters of the separation roller at both ends are smaller than that at the central part is known (for example, refer to Patent Documents 1 and 2).

However, the press roller is formed in the crown shape, thus the diameter of the press roller is different between the central part of the belt and both ends thereof and at the ends where the diameters are smaller than that at the central part, the belt is slacked and the slack may cause an occurrence of creases referred to as surface waviness on the surface of the belt.

Such creases appear on the image surface as uneven gloss and may cause a reduction in the image quality.

DOCUMENT OF PRIOR ART

Patent Document

Patent Document 1: Japanese Patent Application Publication No. Hei 9-90787

Patent Document 2: Japanese Patent Application Publication No. 2002-333789

SUMMARY OF THE INVENTION

Problems to be Solved by the Invention

The present invention was developed with the foregoing in view and is intended to provide an image forming apparatus including a fixing device for fixing an image by a nip portion formed by two rotary members rotating opposite to each other, wherein among the two rotary members of the fixing device, one is a belt which rotates while being stretched around a plurality of rollers and even if a crown-shaped roller is arranged at the exit of the nip portion, no uneven gloss appears on print.

Means for Solving the Problems

The aforementioned problem is solved by realization of the following inventions.

1. A fixing device for fixing an image by a nip portion formed by two rotary members which rotate while facing each other, wherein: at least one of the two rotary members is a belt which rotates while being stretched around a plurality of rollers, among the plurality of rollers, a roller arranged at an exit of the nip portion has a crown shape, and a slack absorbing member for absorbing a slack of both ends of the belt caused by the crown-shaped roller is in contact with the belt.

2. The fixing device described in Item 1, wherein the slack absorbing member is one of the plurality of rollers and has a reverse crown shape.

3. The fixing device described in Item 1, wherein the slack absorbing member is two rollers respectively in contact with both ends of the belt and the two rollers can swing independently.

4. The fixing device described in claim 1, wherein the slack absorbing member is two sliding members respectively sliding on both ends of the belt.

5. The fixing device described in claim 4, wherein the sliding member is pressurized to the belt by an elastic member.

6. An image forming apparatus including a fixing device for fixing an image by a nip portion formed by two rotary members which rotate while facing each other, wherein: at least one of the two rotary members is a belt which rotates while being stretched around a plurality of milers, among the plurality of rollers, a roller arranged at an exit of the nip portion has a crown shape, and a slack absorbing member for absorbing a slack of both ends of the belt caused by the crown-shaped roller is in contact with the belt.

Effects of the Invention

In an image forming apparatus including a fixing device for fixing an image by a nip portion formed by two rotary members rotating opposite to each other, the slack of both ends of the belt occurring when one of the two rotary members is a belt rotating while being stretched around a plurality of rollers and among the plurality of rollers, the roller arranged at the exit of the nip portion has a crown shape is eliminated.

As a result, the occurrence of creases on the belt surface is prevented and the occurrence of uneven gloss appearing on print is prevented.

DETAILED DESCRIPTION OF PREFERRED EMBODIMENT

Hereinafter, the embodiment of the present invention will be explained with reference to the accompanying drawings. Further, the present invention is not limited to the present invention.

Figure 1:
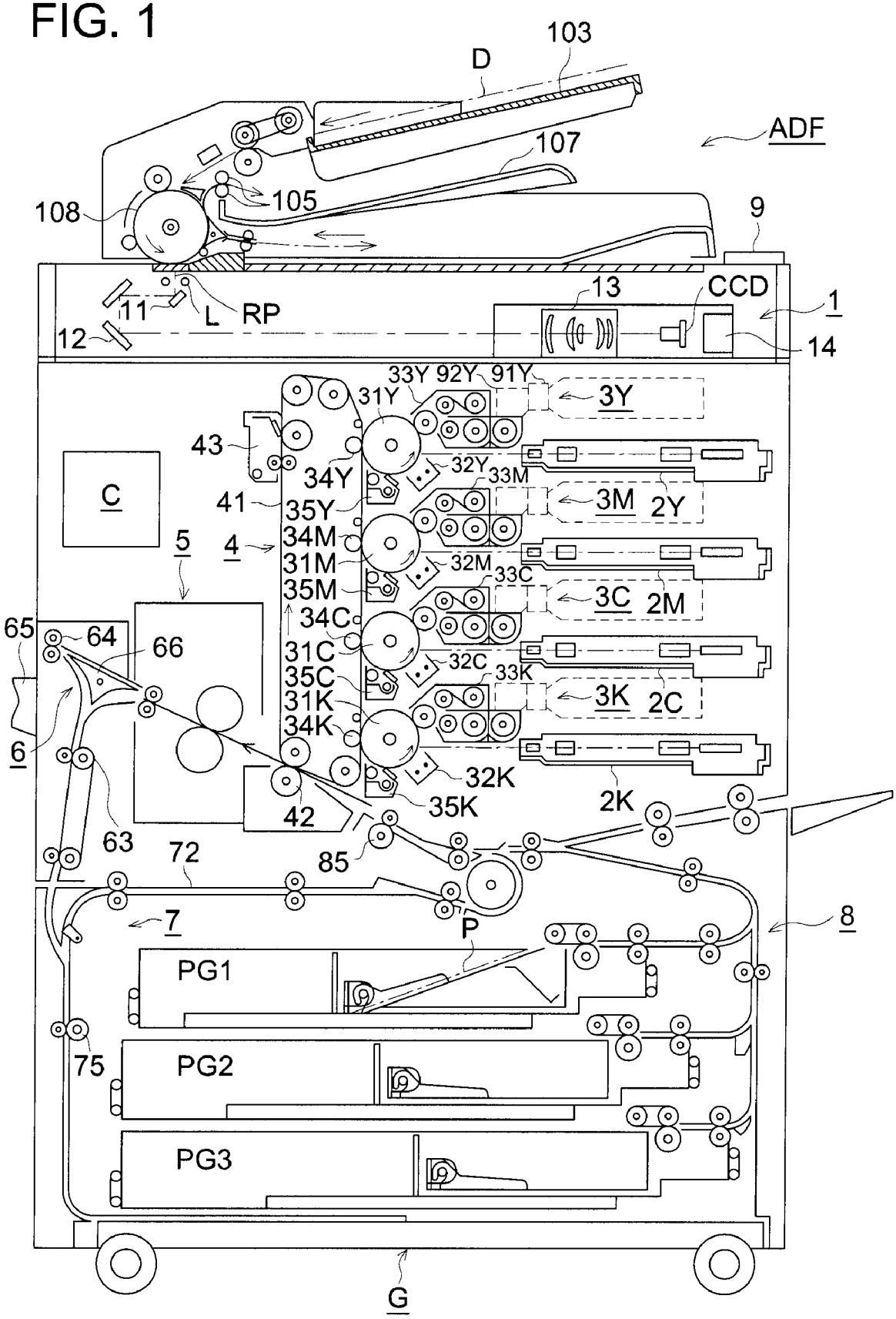
FIG. 1 is a conceptual diagram of the image forming apparatus.

FIG. 1 is a conceptual diagram of an image forming apparatus G.

The color image forming apparatus G illustrated in the drawing is referred to as a tandem color image forming apparatus including a plurality of photoconductors 31Y, 31M, 31C, and 31K which are arranged in a column opposite to one intermediate transfer belt 41 for forming full color images.

The color image forming apparatus G includes an automatic document feeder ADF on the upper part thereof.

Documents D loaded on a document table 103 of the automatic document feeder ADF are separated one by one, are fed onto the document conveying path, and are conveyed by a conveying drum 108.

The images of the documents D under conveyance are read by a document reading unit 1 at a document image reading position RP. The documents D after read are discharged onto a document discharge table 107 by a plurality of conveying guides and document discharge rollers 105.

The image forming apparatus G is composed of the document reading unit 1, exposure units 2Y, 2M, 2C, and 2K, image forming units 3Y, 3M, 3C, and 3K, an intermediate transfer unit 4, a fixing device 5, a reverse sheet discharge unit 6, a sheet refeed unit 7, an operation display unit 9, and a control unit C and these units are all stored in one cabinet.

The document reading unit 1 irradiates the document image by a lamp L at the document reading position RP, leads the reflected light to a first mirror unit 11, a second mirror unit 12, and a lens 13, thereby forms an image on the light receiving surface of an image pickup device CCD.

The image signal photoelectrically conversed by the image pickup device CCD is subjected to the processes such as A-D conversion, shading correction, and compression by an image reading control unit 14 and is stored in the memory of the control unit C as image data.

The image data stored in the memory is subjected to an appropriate image process under the conditions preset by a user, thus output image data is generated.

The exposure units 2Y, 2M, 2C, and 2K are composed of a laser beam source, a polygonal mirror, and a plurality of lenses and generate a laser beam.

The exposure units 2Y, 2M, 2C, and 2K, in correspondence with the output information outputted on the basis of the output image data sent from the control unit C, scans and exposes the surfaces of the photoconductors 31Y, 31M, 31C, and 31K which are components of the image forming units 3Y, 3M, 3C, and 3K by a laser beam.

By the scanning exposure of the laser beam, a latent image is formed on the photoconductors 31Y, 31M, 31C, and 31K.

The image forming unit 3Y is composed of the photoconductor 31Y and a main charger 32Y, a developing unit 33Y, a first transfer roller 34Y, and a cleaning unit 35Y which are arranged around the photoconductor 31Y. The same may be said with the photoconductors 31M, 31C, and 31K.

The latent images on the photoconductors 31Y, 31M, 31C, and 31K are developed by the corresponding developing units 33Y, 33M, 33C, and 33K, thus toner images are formed on the respective photoconductors.

The toner images formed on the photoconductors 31Y, 31M, 31C, and 31K are sequentially transferred to predetermined positions on the intermediate transfer belt 41, which is an intermediate transfer body, by the first transfer rollers 34Y, 34M, 34C, and 34K of the intermediate transfer unit 4.

From the surfaces of the photoconductors finishing transfer of the toner images, residual toner is removed by the cleaning units 35Y, 35M, 35C, and 35K.

On the other hand, the toner images transferred onto the intermediate transfer belt 41 are conveyed from sheet feed trays PG1, PG2, and PG3 of the sheet feed unit 8 by second transfer rollers 42 and are transferred onto the sheet P sent timely from sheet feed rollers 85.

The intermediate transfer belt 41 finishing the transfer of the toner image onto the sheet P is cleaned for the surface thereof by a belt cleaning unit 43 and is transmitted to the next image transfer.

On the other hand, the sheet P carrying the toner images is sent to the fixing device 5 and is heated under pressure by the rollers arranged opposite to each other or the belt, thus the toner images are fixed to the sheet P.

The sheet P finishing the fixing process by the fixing device 5 is led on the route by the sheet reverse discharge unit 6 and is discharged onto a sheet discharge table 65.

When discharging the sheet P by reversing the front and rear thereof, the sheet P is led downward once by a sheet discharge guide 62, and the rear end of the sheet P is held by sheet discharge reversing rollers 63, and then the sheet P is reversed and it is led to sheet discharge rollers 64 by the sheet discharge guide 62 and is discharged.

Further, when forming an image also on the rear of the sheet P, the sheet P finishing the fixing of the surface image is conveyed to the sheet refeed unit 7 arranged downward by a sheet guide member 66, and the rear end is held by sheet refeed reversing rollers 75, and then the sheet P is fed reversely to be reversed, is fed to a sheet refeed conveying path 72, and is transmitted to image formation on the rear.

Figure 2:
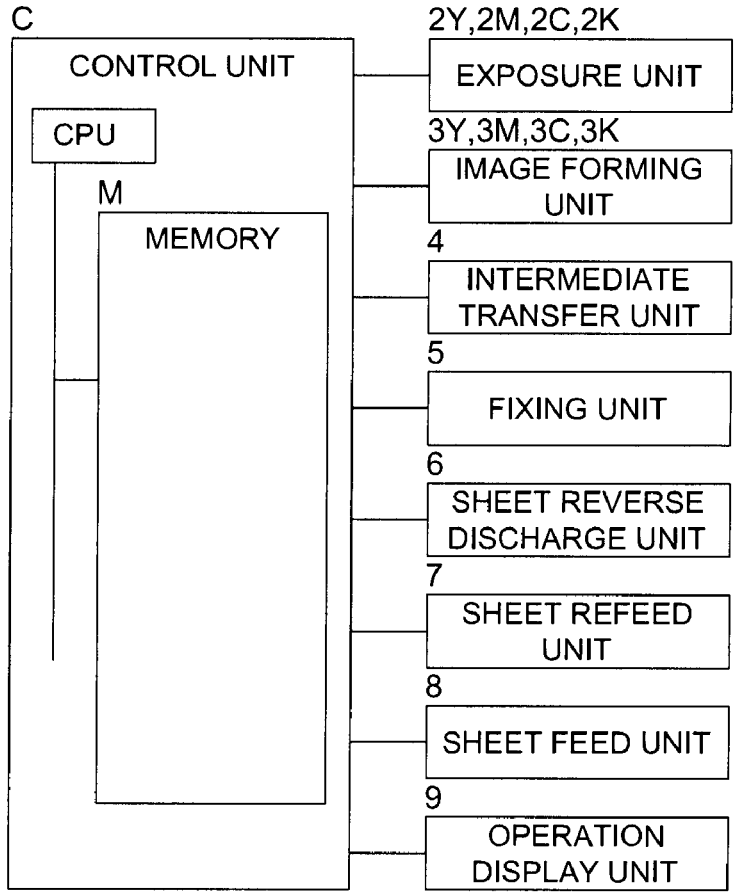
FIG. 2 is a block diagram showing the control relation of the image forming apparatus.

FIG. 2 is a block diagram showing the control relation of the image forming apparatus G The control unit C of the image forming apparatus G is a computer system including a CPU, a memory M, a calculation unit, an I/O port, a communication interface, and a drive circuit.

The control by the control unit C is realized by execution of a predetermined program stored in the memory M.

Further, the control unit C is connected to the network and can execute information exchange with other information processing units.

Further, in this drawing, the description of the blocks not directly related to the explanation of the present invention is omitted.

FIG. 3 is a drawing showing a configuration example of the fixing device 5.

The fixing device 5 shown in the drawing is composed of a fixing roller 51 internally having a heater, a belt 52, a separation roller 53, a steering roller 54, an inlet roller 55, and a pressure pad 56 and heats a sheet moving forward in the direction of an arrow x under pressure by conveying it, thereby fixes the toner images.

Figure 3A:
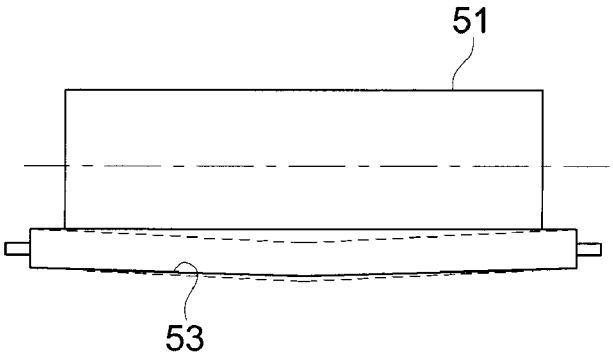
FIG. 3 is a drawing showing a configuration example of the fixing device.
Figure 3B:
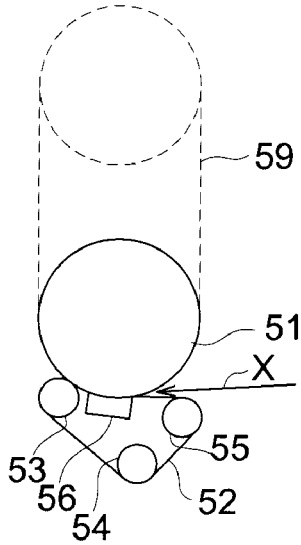

Further, the fixing roller 51 may use a fixing belt 59 which is heated and stretched around a plurality of rollers as shown by a dotted line in FIG. 3*b*.

The separation roller 53 arranged at the exit of the nip portion is a roller for pressurizing the belt 52 against the fixing roller 51, though bending as shown typically by a dotted line in FIG. 3*a* occurs and as a result, the pressure to the central part of the belt becomes smaller than the pressure to both ends of the belt.

Such ununiform pressure may cause defective fixing or uneven fixing, so that a technological measure to form the separation roller 53 in the so-called crown shape that the diameter at the central part is made larger than the diameters at both ends is adopted.

However, by use of the separation roller 53 in the crown shape, the pressure of the belt 52 to the fixing roller 51 is made uniform overall the width of the belt 52, though the winding way of the belt 52 is different between the central part and both ends.

Such a state causes creases referred to as surface waviness on the surface of the belt 52 and the creases appear on the image surface after fixing as uneven gloss.

FIG. 4 is a conceptual diagram of creases appearing on the belt surface.

Figure 4A:
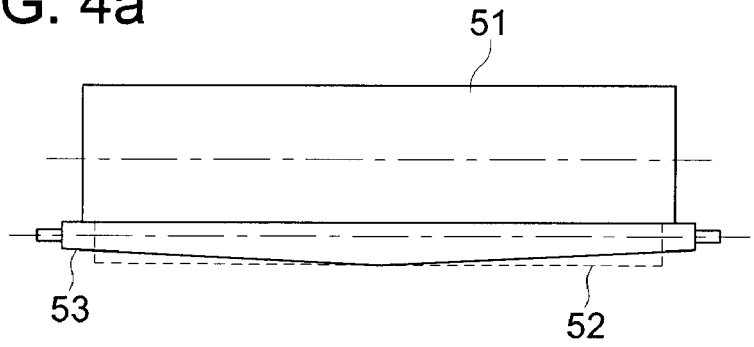
FIG. 4 is a conceptual diagram of creases appearing on the belt surface.
Figure 4B:
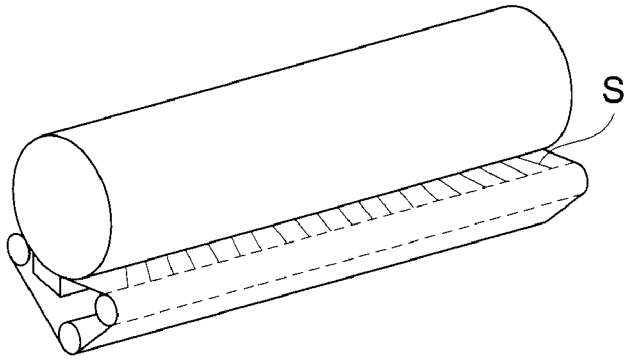
Figure 4C:
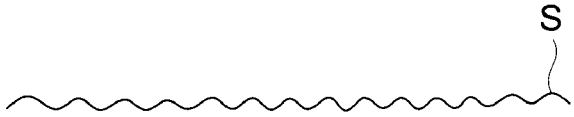

The dotted line in FIG. 4*a* shows the condition that bending is formed at both ends of the belt 52 wound round the crown-shaped fixing roller 51 and FIGS. 4*b* and 4*c* show the shape of the surface waviness which is typical creases S occurring on the belt surface.

Therefore, it is an important theme to suppress such slack occurring at both ends of the belt 52, thereby prevent an occurrence of creases of the belt surface, and maintain the image quality of print.

Figure 5:
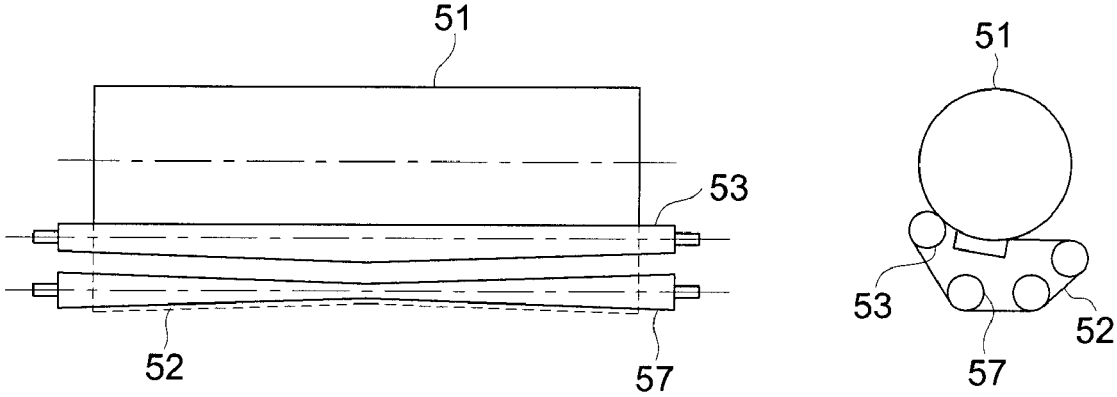
FIG. 5 is a drawing for explaining slack absorption by the roller in a reverse crown shape.

FIG. 5 is a drawing for explaining slack absorption by the roller 57 in the reverse crown shape.

The roller 57 in the reverse crown shape shown in the drawing is one of a plurality of rollers for stretching the belt 52 and is a slack absorbing member installed to absorb the slack of the belt 52 which occurs by the separation roller 53 in the crown shape.

Further, the roller 57 in the reverse crown shape is preferably supported so as to pressurize the belt 52 with the pressure of a predetermined magnitude by the experimentation.

Further, the roller 57 in the reverse crown shape does not need to be a roller continued in the longitudinal direction as illustrated in FIG. 5 and may be a roller structured so as to be divided appropriately in the longitudinal direction and permit the divided roller portions to make independently contact with the belt. It will be illustrated below.

Figure 6:
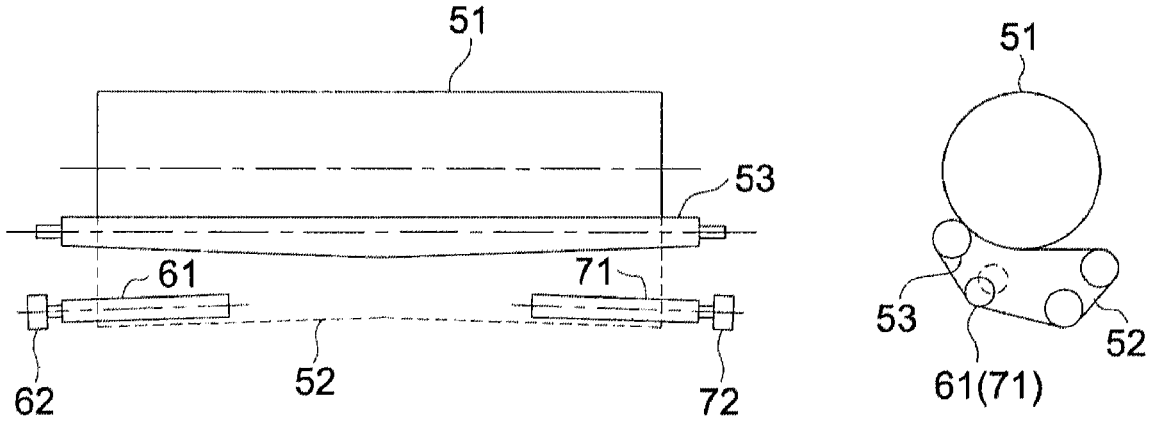
FIG. 6 is a drawing for explaining slack absorption by the two rollers in contact with the ends of the belt.

FIG. 6 is a drawing for explaining slack absorption by two rollers 61 and 71 in contact with the ends of the belt 52.

The two rollers 61 and 71 are supported by roller support members 62 and 72 at one end and can swing independently. The rollers 61 and 71 make respectively contact with both ends of the inner peripheral surface of the belt 52. The shafts of the two rollers 61 and 71 can shift in the direction almost perpendicular to the conveying direction of the belt 52 and the rollers 61 and 71 are a slack absorbing member structured so as to pressurize the belt 52 outside by a load given by an elastic member such as a spring.

Figure 7:
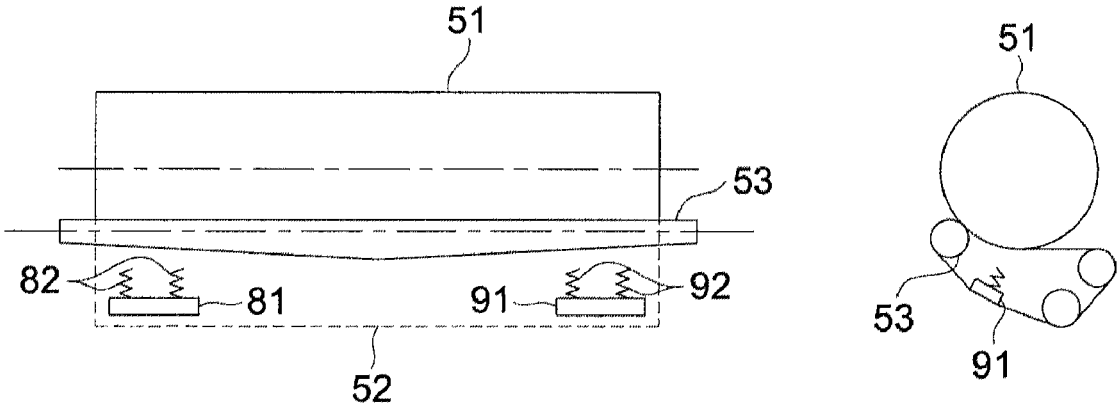
FIG. 7 is a drawing for explaining slack absorption by the sliding member.

FIG. 7 is a drawing for explaining slack absorption by sliding members 81 and 91.

The sliding members 81 and 91 are slack absorbing members sliding in contact with both ends of the belt 52 by springs 82 and 92 which are elastic members.

In FIGS. 5, 6, and 7, the slack absorbing member for absorbing the slack of the belt 52 is explained, though the pressurizing direction to the belt 52 by the slack absorbing member, as illustrated, may be the direction from the inner peripheral surface side of the belt 52 to the outside or the direction from the outer peripheral surface side of the belt 52 to the inside.

Further, the position where the slack absorbing member is pressurized to the belt 52 does not to be in the neighborhood of the separation roller 53 as illustrated in FIGS. 5, 6, and 7 and may be in the neighborhood of the inlet roller 55 and it is decided in consideration of the stretching condition of the belt 52 to the roller and the absorption effect.

DESCRIPTION OF NUMERALS

5 Fixing device
52 Belt
53 Separation roller
57 Roller in the reverse crown shape (slack absorbing member)
61, 71 Roller (slack absorbing member)
81, 91 Sliding member (slack absorbing member)
82, 92 Spring (elastic member)
G Image forming apparatus

The invention claimed is:

1. A fixing device for fixing an image by a nip portion formed by two rotary members which rotate while facing each other, wherein:

at least one of the two rotary members is a belt which rotates while being stretched around a plurality of rollers, among the plurality of rollers, a roller arranged at an exit of the nip portion has a crown shape, a slack absorbing member for absorbing a slack of both ends of the belt caused by the crown-shaped roller is in contact with the belt, and the slack absorbing member is two rollers respectively in contact with both ends of the belt and the two rollers can swing independently.

2. A fixing device for fixing an image by a nip portion formed by two rotary members which rotate while facing each other, wherein:

at least one of the two rotary members is a belt which rotates while being stretched around a plurality of rollers, among the plurality of rollers, a roller arranged at an exit of the nip portion has a crown shape, a slack absorbing member for absorbing a slack of both ends of the belt caused by the crown-shaped roller is in contact with the belt, and the slack absorbing member is one of the plurality of rollers and has a reverse crown shape.

3. An image forming apparatus including a fixing device for fixing an image by a nip portion formed by two rotary members which rotate while facing each other, wherein:

at least one of the two rotary members is a belt which rotates while being stretched around a plurality of rollers, among the plurality of rollers, a roller arranged at an exit of the nip portion has a crown shape, a slack absorbing member for absorbing a slack of both ends of the belt caused by the crown-shaped roller is in contact with the belt, and the slack absorbing member is two rollers respectively in contact with both ends of the belt and the two rollers can swing independently.

4. An image forming apparatus including a fixing device for fixing an image by a nip portion formed by two rotary members which rotate while facing each other, wherein:

at least one of the two rotary members is a belt which rotates while being stretched around a plurality of rollers, among the plurality of rollers, a roller arranged at an exit of the nip portion has a crown shape, a slack absorbing member for absorbing a slack of both ends of the belt caused by the crown-shaped roller is in contact with the belt, and the slack absorbing member is one of the plurality of rollers and has a reverse crown shape.

* * * * *